US006030143A

United States Patent [19]

Kreitzberg

[11] Patent Number: 6,030,143

[45] Date of Patent: Feb. 29, 2000

[54] LOCKING PIN FOR EXCAVATING EQUIPMENT

[75] Inventor: John S. Kreitzberg, Portland, Oreg.

[73] Assignee: Esco Corporation, Portland, Oreg.

[21] Appl. No.: 08/993,173

[22] Filed: Dec. 18, 1997

[51] Int. Cl.[7] ..... B25G 3/20

[52] U.S. Cl. ..... 403/374.1; 403/355; 403/379.4; 403/379.6; 37/457; 37/455; 172/753

[58] Field of Search ..... 403/291, 374.1, 403/373, 355, 379.4, 379.6; 37/456, 457, 455; 172/772.5, 753

[56] References Cited

U.S. PATENT DOCUMENTS 2,772,492 12/1956 Murtaugh .
2,870,667 1/1959 Murtaugh .
2,982,035 5/1961 Stephenson .
3,894,349 7/1975 Moreau .
4,155,665 5/1979 Kaarlela .
4,192,089 3/1980 Schwappach .
4,282,665 8/1981 Fletcher et al. .
4,335,532 6/1982 Hahn et al. .
4,446,638 5/1984 Novotny et al. .
4,481,728 11/1984 Mulder et al. ..... 37/456 X
5,469,648 11/1995 Jones et al. .

*Primary Examiner*—Lynne H. Browne
*Assistant Examiner*—David E. Bochna
*Attorney, Agent, or Firm*—Banner & Witcoff, Ltd.

[57] ABSTRACT

An improved locking pin for locking together two pieces of equipment through aligned locking apertures. The pin comprises a steel casing, a steel insert and an elastomer member. The two steel parts assemble together in a particular sequence and are adjusted so that when completely assembled, the insert is locked into the casing with the body of the casing and the insert being parallel and spaced from one another. The elastomer member is interposed in the space defined between the casing and insert, and fills the space between the steel parts. The assembled steel parts are firmly locked together by introduction of the elastomer member into that space. There is no adhesive joining the steel and elastomer members which makes the pin more amenable for use in corrosive environments and also eases manufacture of the pin components. A tightly constructed locking pin also avoids the problems of the components becoming loose or lost.

22 Claims, 13 Drawing Sheets

LOCKING PIN FOR EXCAVATING EQUIPMENT

FIELD OF THE INVENTION

The present invention pertains to an improved locking pin for use in securing points to adapters on excavating equipment of all kinds, and especially for use in dredge equipment.

BACKGROUND OF THE INVENTION

In mining and construction, excavating equipment ordinarily include a series of spaced apart teeth mounted across the digging edge of the excavator (e.g. the lip of a bucket). The teeth project forwardly to engage and break up the material to be gathered in the bucket. As can be appreciated, the teeth are subjected to highly abrasive conditions and experience considerable wearing.

In order to minimize the throw away material from used replacement parts, the teeth are manufactured of multiple parts, including an adapter and a point. The adapter is attached to the bucket's lip and includes a forwardly projecting nose. The point includes a front digging end and defines a rearwardly opening socket into which the adapter nose is received. In this way, the point substantially envelops the adapter nose. The point is therefore subjected to abrasive conditions and must be frequently replaced. The points must be securely locked to the adapters to withstand the heavy loading, but still be easily set and released for replacement of points in the field. The locking pin must also be able to withstand any of the environmental conditions to which the teeth are exposed, preferably including potentially corrosive conditions such as working in salt water.

In general, the point and adapter nose are provided with complimentary locking apertures for receiving a locking pin. A wide variety of point-adapter nose configurations are possible. A few examples are described in U.S. Pat. No. 5,469,648, which is incorporated by reference in its entirety. When the parts are assembled, the apertures are aligned to enable receipt of a locking pin. In some cases, a rigid pin is used in combination with a resilient keeper member. The keeper member is employed to hold the pin in the apertures and to tighten the engagement of the point over the adapter nose. In an alternative arrangement, a sandwich pin is used without a separate keeper member. In general, a sandwich pin has a pair of a rigid portions which are combined with a resilient portion in an integral construction such that the pin works to secure the point in place and tighten the connection of the parts.

While sandwich pins offer the convenience of using a single locking part, forming a pin with a cohesive, durable construction can be a problem. For instance, the resilient portion and the metal portion are typically fixed together with an adhesive to maintain the pin as a single part. There is great reliance therefore on the adhesive bond between the pieces. However, adhesives can fail in corrosive environments resulting in detachment of the pieces of a locking pin and loss of the pin.

During use, the pin is continuously loaded causing the metal portion to move against the resilient portion in a cyclic manner. The resilient material can lose its resilience through fatigue failure due to continuous loading so that the material is not sufficiently expansive to hold the pin in the aligned apertures. Loss of the pin results in a lost point, which, in turn, exposes the adapter to premature wear and possible damage to the equipment receiving the overburden with the lost point.

The continuous loading can also have an adverse effect on the adhesive bond between the resilient portion and the metal portion resulting in a fatigue failure of the bond.

In most lock assemblies employing sandwich pins, the elastomeric element in the pin must expand to maintain a tight fit in the aligned assembly apertures and prevent loss of the pin. Once the maximum expansion of the elastomer member is reached, the pin may be lost or ejected. Therefore, in order to maximize the life of the components the apertures defined through the point and adapter nose, irrespective of whether they are vertical or horizontal apertures, are typically constructed so that the pin is initially inserted into a very tight arrangement.

In order to keep the elastomer element and the rigid elements of the pin together, most sandwich pin components are manufactured by inserting the rigid metal elements into a mold, coating an adhesive on the metal elements and then injection molding the elastomer element. This injection molding method is typically labor intensive requiring manual placement of the metal elements into the mold, molding and then removing the part from the mold. In addition to the manual positioning, molding, and removing steps, this manufacturing method requires cleaning of the part where primer and adhesive were coated on the metal elements, and also cleaning the flashing and sprues from the part.

U.S. Pat. No. 5,469,648 to Jones, et al. discloses an excavating tooth secured together with a sandwich lock pin. The lock pin includes a rigid casing formed with one or two cavities for receiving elastomeric material and metal coverings which overlay the elastomeric material to prevent premature wearing. The cavities into which the coverings are received, however, are too shallow to retain the coverings during use. Consequently, adhesive or the like is required to secure the coverings against loss. A failure of the adhesive due to corrosion or fatigue will result in a failure of the pin and loss of the point or other wear member.

U.S. Pat. No. 2,772,492 to Murtaugh discloses a retaining key for securing the adapter of a dipper tooth to a lip of a bucket. The retaining key comprises a C-shaped member, a wedge and a resilient pad interposed between them. Although the wedge has projections which are received into recesses the recesses are laterally open on one side. As a result, there is no provision for laterally constraining the wedge within the casing. During installation and use the wedge could slide out the side of the casing and be lost.

SUMMARY OF THE INVENTION

The present invention relates to an improved locking pin for use in securing a wear member to a base, such as a point to an adapter, and especially for use with dredge products. The pin comprises two cooperative steel parts, a casing and an insert, and an elastomer part. The casing and insert have longitudinal bodies which are generally parallel and spaced from one another. The two steel parts are assembled together in a particular sequence so that the components are firmly held together and constrained from movement in all but one direction—toward and away from one another. The elastomeric member is interposed between the assembled steel parts to resiliently bias the metal parts away from one another so that the parts are tightly constrained in all directions. The tight arrangement also does away with the need for an adhesive to bond the elastomer to the metal. Accordingly, the pin can be used without fear of an adhesive failure due to fatigue or to a corrosive environment.

By eliminating the need for an adhesive, manufacture of the parts is also eased by the elimination of at least three steps: inserting the metal parts into a mold; coating an adhesive to the metal parts; and cleaning the part of adhesive primer, flashing and sprues after molding. Since all of these steps are typically manual, time and labor are also saved by manufacturing the components independently and then assembling them together. The elastomeric member of the present invention is preferably manufactured separately in a largely automated line which can produce pieces that do not require as much cleaning or finishing due to the use of high quality tooling.

These and other features and advantages of the invention may be more completely understood from the following detailed description of the preferred embodiments of the invention with reference to the accompanying drawings.

DETAILED DESCRIPTION OF THE PREFERRED EMBODIMENTS

Figure 1:
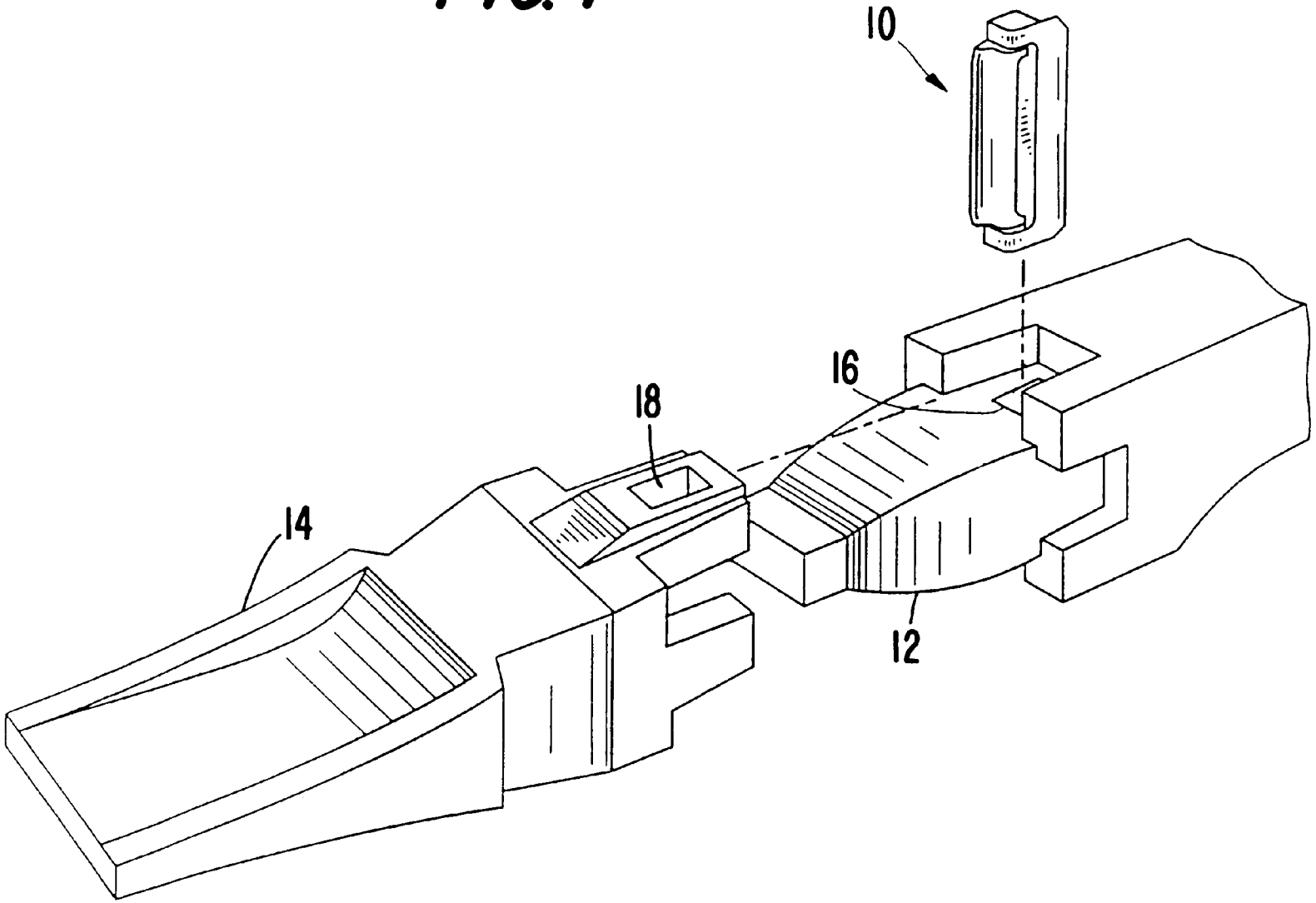
FIG. 1 is an exploded, partial perspective view of an adapter and point being assembled together with a locking pin in accordance with a preferred embodiment of the present invention.

The present invention pertains to an improved locking pin for locking together any two pieces which are provided with aligned locking apertures. For ease of explanation, the locking pin of the present invention is generally described in this application in the exemplary context of locking together an adapter and a point of a tooth on excavating equipment. It is contemplated that the improved locking pin described herein could be used with a variety of other equipment. Operation of excavating equipment can cause the tooth and the locking pin to assume many different orientations. The components of the locking pin define certain absolute orientations or directions with respect to one another. The three main directional references used in this description are the longitudinal direction of the pin components, and first and second lateral directions which are orthogonal to one another and to the longitudinal direction. In addition, the locking pin and its elements are at times described with reference to relative directions such as front, rear, side, top and bottom. These relative directions are chosen arbitrarily for ease of explanation with the drawings only, and do not necessarily comport with the orientation that the pin may take in its working environment.

In the preferred embodiment of the present invention (FIGS. 1–17), a locking pin 10 is used to lock together an adapter nose 12 and point 14 by insertion of the pin into aligned locking apertures 16 and 18 respectively. Nevertheless, the locking pin can be used to secure other wear members to a base in various excavating equipment. Locking pin 10 comprises a casing 20, an insert 22 and an elastomer member 24.

Figure 13:
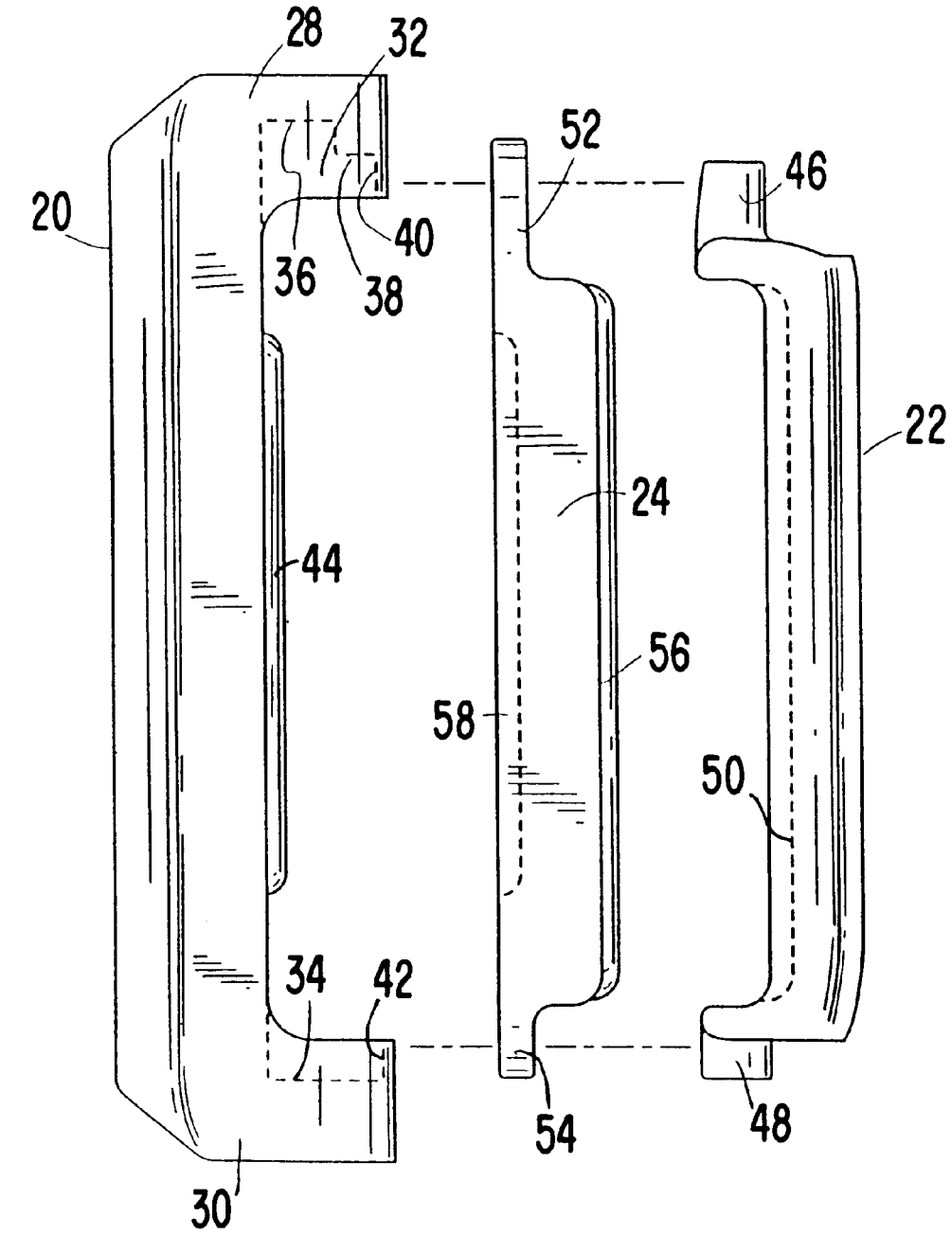
FIG. 13 is an exploded assembly view of the locking pin pieces of FIG. 2.
Figure 14:
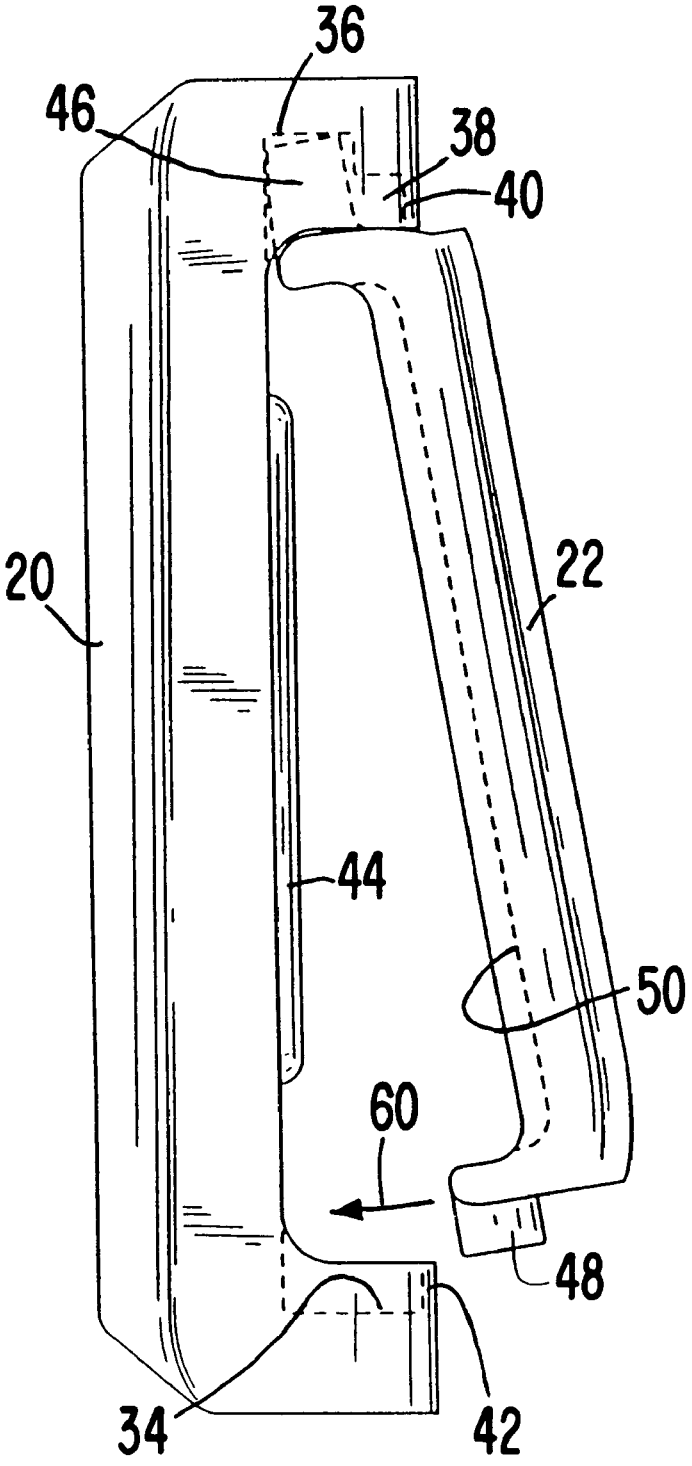
FIG. 14 is an assembly view of the locking pin of FIG. 2 showing the first engagement of the insert to the casing.
Figure 15:
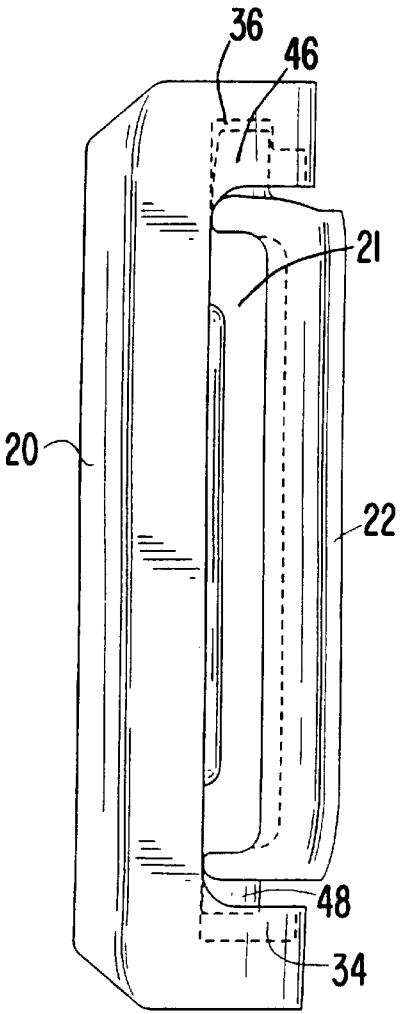
FIG. 15 is an assembly view of the locking pin of FIG. 2 showing the assembly of both ends of the insert to the casing.
Figure 16:
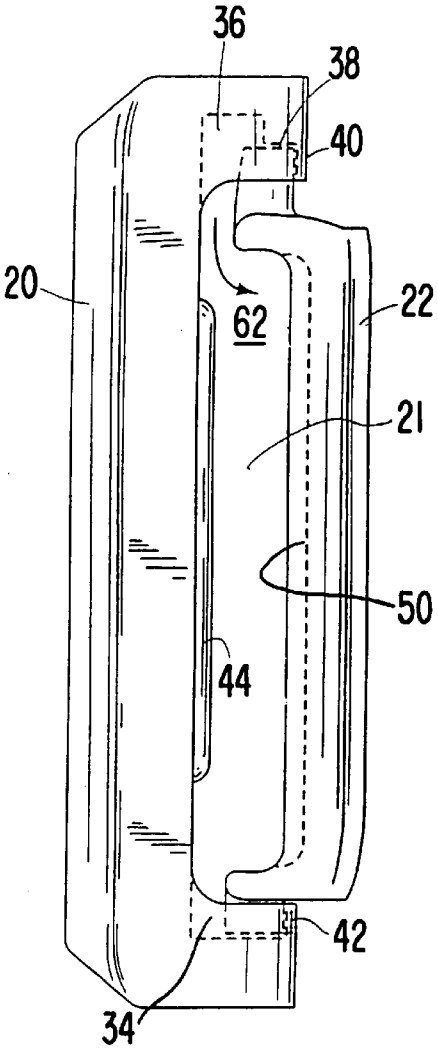
FIG. 16 is an assembly view of the locking pin of FIG. 2 showing the insert fitted into the casing.

Casing 20 is formed to have a generally C-shape with a longitudinal body portion 26 and laterally extending arms 28 and 30 which face one another. Arms 28 and 30 each have a receiving recess 32 and 34, respectively, on the side that faces the opposite arm (FIG. 13). Recess 32 has a stepped configuration with a deeper and larger portion 36 proximate the body and a shallower and smaller portion 38 remote from the body. This remote portion 38 is closed at its outer end by a locking abutment 40. Recess 34 has a smoothly contoured configuration with a locking abutment 42 at its outermost end. A longitudinal rib 44 is also preferably provided along the interior of body portion 26 to provide lateral support and an increased elastomer engagement surface to prevent unintended lateral movement of the elastomer.

Insert 22 has a longitudinal body which is designed to overlay the elastomer when the locking pin is assembled. Insert 22 is assembled into casing 20 so that their bodies are generally parallel and spaced from one another (FIGS. 3–5 and 13). Each end of insert 22 is provided with a tab that projects outwardly in the same longitudinal direction as the body. The tabs are not identical and are shaped to mate with the recesses of casing 20. Tab 46 is shaped for assembly into recess 32, whereas tab 48 is shaped for assembly into recess 34. More specifically, tab 46 has a shape which corresponds to shallow portion 38 of recess 32. Likewise, tab 48 has a shape that corresponds to the shape of recess 34. With tabs 46 and 48 received in recesses 32 and 34 and adjusted so that they abut locking abutments 40 and 42, respectively, the insert is constrained from movement relative to the casing in the longitudinal direction and a first lateral direction. Since the sides of the recesses matingly engage the tabs of the insert, the recesses also limit any rotation of the insert relative to the casing. As a result, the insert and casing body can only move toward and away from one another, and thus has only one degree of freedom in a second lateral direction. Insert 22 preferably has a longitudinal slot 50 along the surface that faces casing 20 for receiving a corresponding rib on the elastomer and providing a gripping location when the pin is completely assembled.

Figure 2:
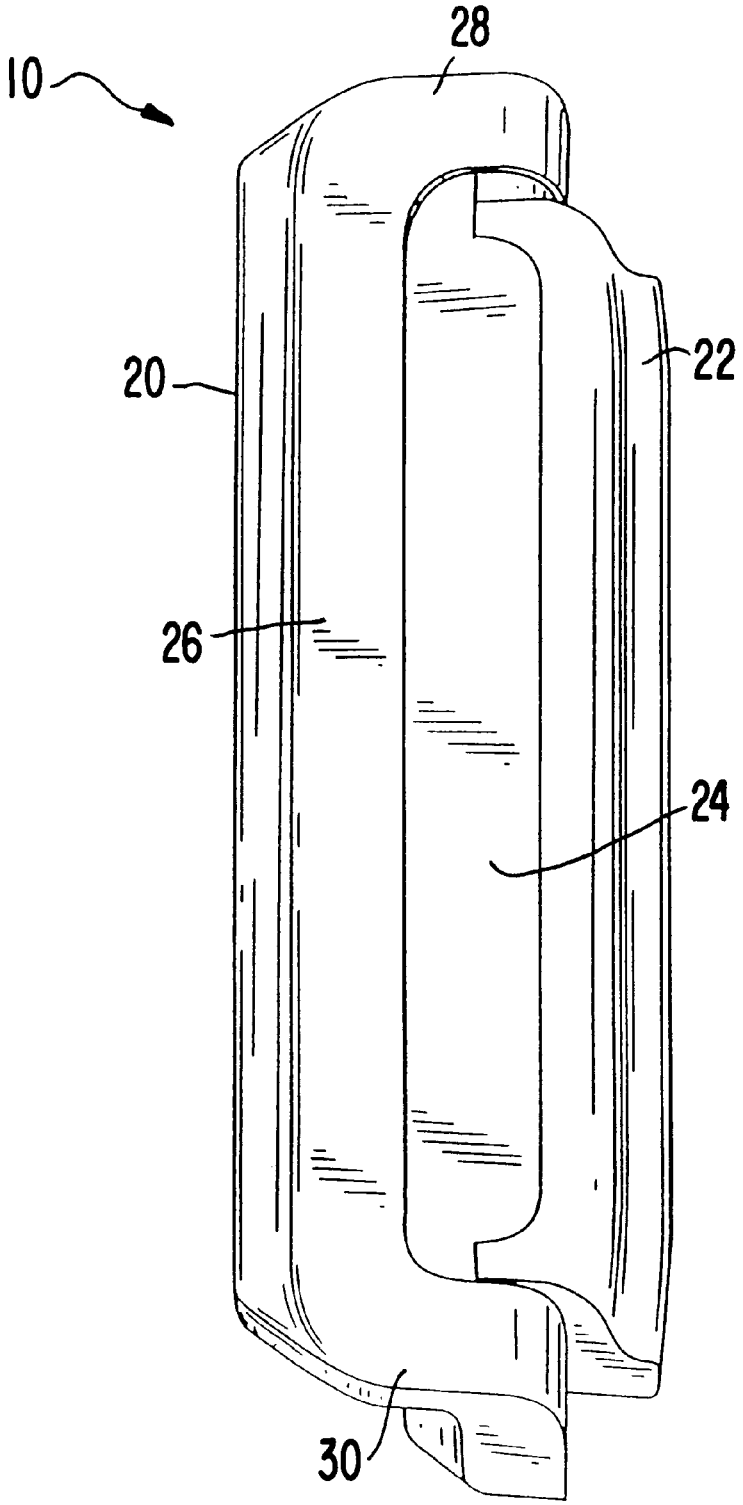
FIG. 2 is a perspective view of the locking pin of the present invention shown assembled with an elastomer in place.
Figure 3:
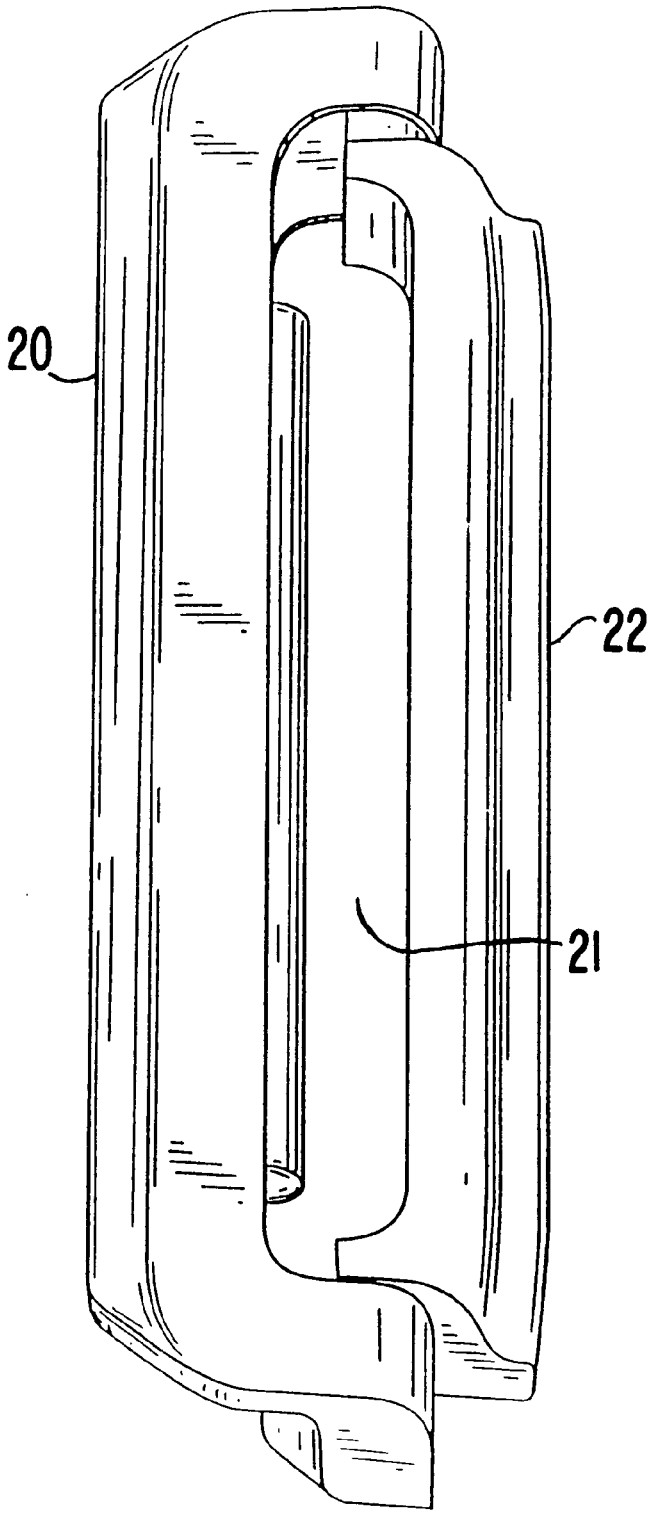
FIG. 3 is a perspective view of the locking pin of FIG. 1 shown without the elastomer.
Figure 4:
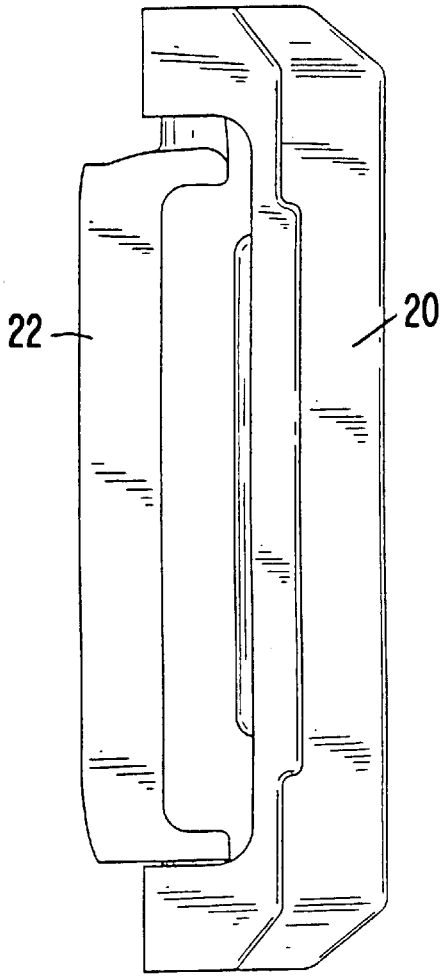
FIG. 4 is an elevational view of the front side of the locking pin of FIG. 3.
Figure 5:
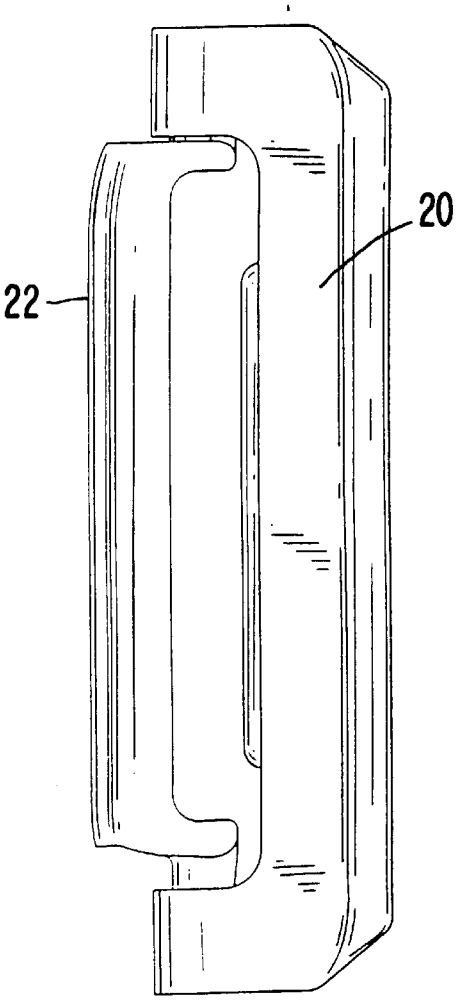
FIG. 5 is an elevational view of the rear side of the locking pin of FIG. 3.
Figure 6:
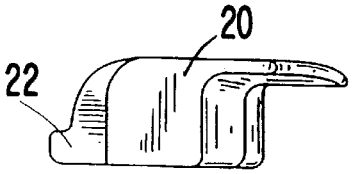
FIG. 6 is an end elevational view of the locking pin of FIG. 3.
Figure 7:
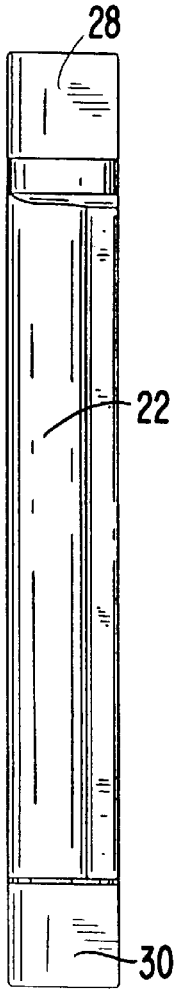
FIG. 7 is an elevational view of one side of the locking pin of FIG. 3
Figure 8:
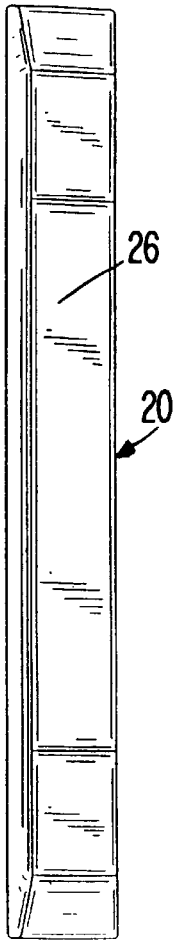
FIG. 8 is an elevational view of the other side of the locking pin of FIG. 3.
Figure 9:
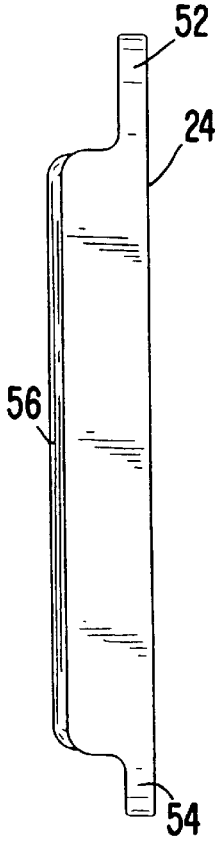
FIG. 9 is an elevational view of one side of the elastomer, the opposite side is shown in FIG. 13.
Figure 10:
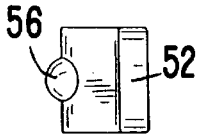
FIG. 10 is an end elevational view of the elastomer of FIG. 9.
Figure 11:
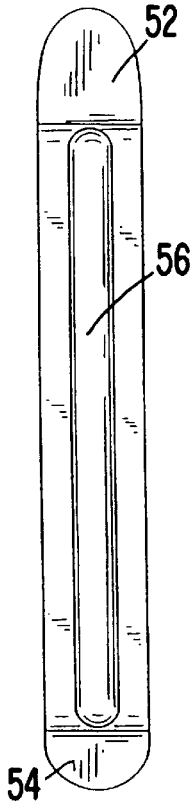
FIG. 11 is an elevational view of the ribbed side of the elastomer of FIG. 9.
Figure 12:
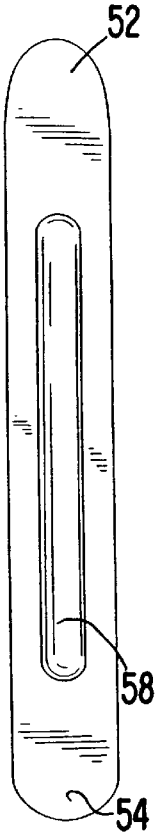
FIG. 12 is an elevational view of the slotted side of the elastomer of FIG. 9.

Elastomer 24 has a shape that is similar to insert 22, although the dimensions are different for reasons that will be apparent. Elastomer 24 has a body with a pair of outwardly projecting tabs 52 and 54. Tab 52 is sized and shaped for receipt into the deeper portion 36 of recess 32. Tab 54 is received into recess 34. In an assembled locking pin, elastomer 24 is interposed between casing 20 and insert 22 (FIGS. 2 and 13). The body of elastomer 24 is generally longitudinal and includes a longitudinal rib 56 on the insert side which is received into slot 50 of the insert, and a longitudinal slot 58 on the casing side to receive rib 44 of the casing.

The assembly process of the casing and insert are shown progressively in FIGS. 14–17. To assemble the casing and insert together, insert 22 is fitted into locking relation with casing 20 by insertion of longer tab 46 into deeper portion 36 of recess 32, thereby tilting the insert with respect to the casing. This allows shorter tab 48 to clear abutment 42 of casing, as indicated by arrow 60, and be received in recess 34. When insert 22 is straightened out, FIG. 15, tab 46 is seated within deep recess 36 and the bodies of casing 20 and insert 22 are brought into parallel relation. Insert 22 is then moved outward with respect to casing body 20, FIG. 16, in the direction of arrow 62 so that tab 46 is seated in shallow portion 38 of recess 32 and bears against locking abutment 40. Simultaneously tab 48 moves outward so that it bears against locking abutment 42. In this manner tabs 46 and 48 are matingly received in recesses 32 and 34 so that the tabs bear against abutments 40 and 42 respectively. Casing 20 and insert 22 thereby define a space 21 therebetween.

Figure 17:
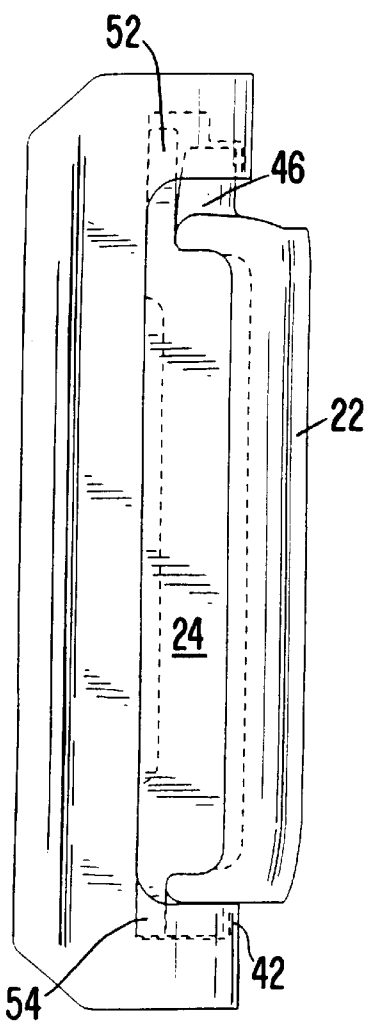
FIG. 17 is an assembly view of the locking pin of FIG. 2 showing the insert completely assembled into the casing and with the elastomer in place.

The assembled casing and insert are firmly locked together by introducing elastomer member 24 into space 21 defined between them. Elastomer 24 also essentially fills in the portions of recesses 32 and 34 of the casing adjacent the body, and the space in between the casing and insert (FIG. 17). This interposition of the elastomer member between the casing and insert prevent the insert from slipping into deeper portion 36 of recess 32 and becoming loose or disassembled. For enhanced engagement, longitudinal slot 58 of elastomer 24 receives longitudinal rib 44 of the casing, and longitudinal rib 56 of elastomer 24 is received in longitudinal slot 50 of the insert. These mated rib and slot relationships ensure that lateral movement of the elastomer is prevented and also provide a greater surface area of engagement between the elastomer and the metal parts.

While in the preferred embodiment the elastomer has a slot on the casing side and a rib on the insert side, it is to be understood that these could be reversed with a corresponding change in the slot and rib of the casing and insert. In addition, any other means of enhancing the engagement of these components are contemplated to be within the scope of this invention. For instance, a series of protrusions and mating recesses could be used in place of the solid rib and slot.

The assembly structures of the casing and insert, i.e. the recesses and tabs, can be arranged in a variety of configurations which allow for sequential assembly and locking and restraining once pulled into parallel relation. FIGS. 18–21 illustrate further preferred embodiments of the casing and insert. In these figures, the components are shown in an elevational view similar to FIG. 4.

Figure 18:
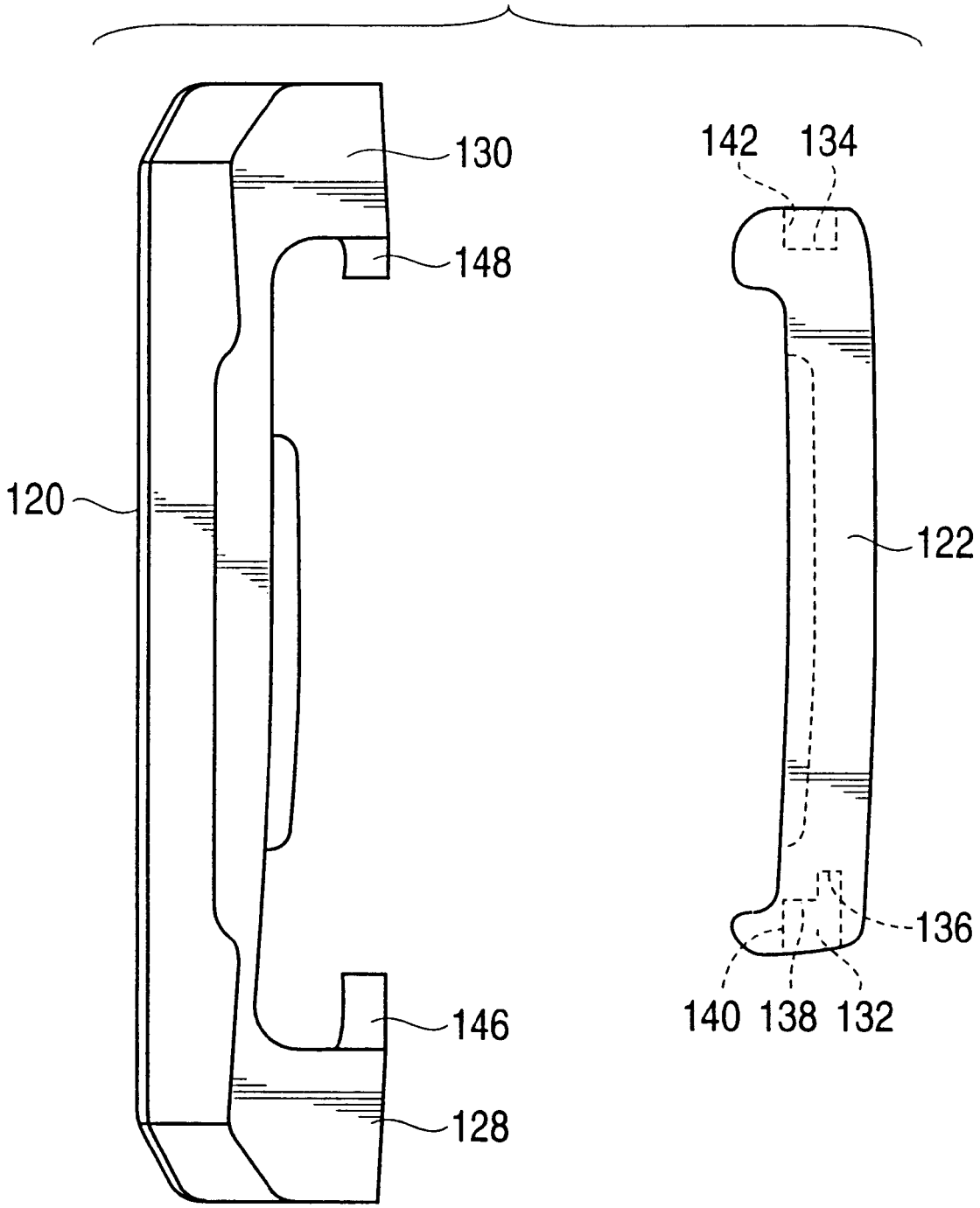
FIG. 18 is an exploded assembly view of the casing and insert in accordance with a second preferred embodiment of the locking pin.

In a second preferred embodiment, FIG. 18, casing 120 is provided with assembly tabs 146 and 148 on arms 128 and 130 respectively. Assembly tabs 146 and 148 are received into recesses 132 and 134, respectively. Assembly of the insert and casing of this pin would occur in a similar sequence to that of the first embodiment. Insert 122 is tilted so that tab 146 is inserted into deeper portion 136 of recess 132. This allows tab 148 to clear abutment 142 of the casing, and be received in recess 134. When insert 122 is straightened out, tab 146 is seated within deep recess 136 and the bodies of casing 120 and insert 122 are brought into parallel relation. Insert 122 is then moved outward with respect to casing body 120 so that tab 146 is seated in shallow portion 138 of recess 132 and bears against locking abutment 140. Simultaneously tab 148 moves to bear against locking abutment 142. In this manner tabs 146 and 148 are matingly received in recesses 132 and 134 so that the tabs bear against abutments 140 and 142 respectively. They are thus constrained from movement in any direction except translationally toward and away from one another. Into the space defined between casing 120 and insert 122, an elastomer is interposed as described above to further lock the components into place.

Figure 19:
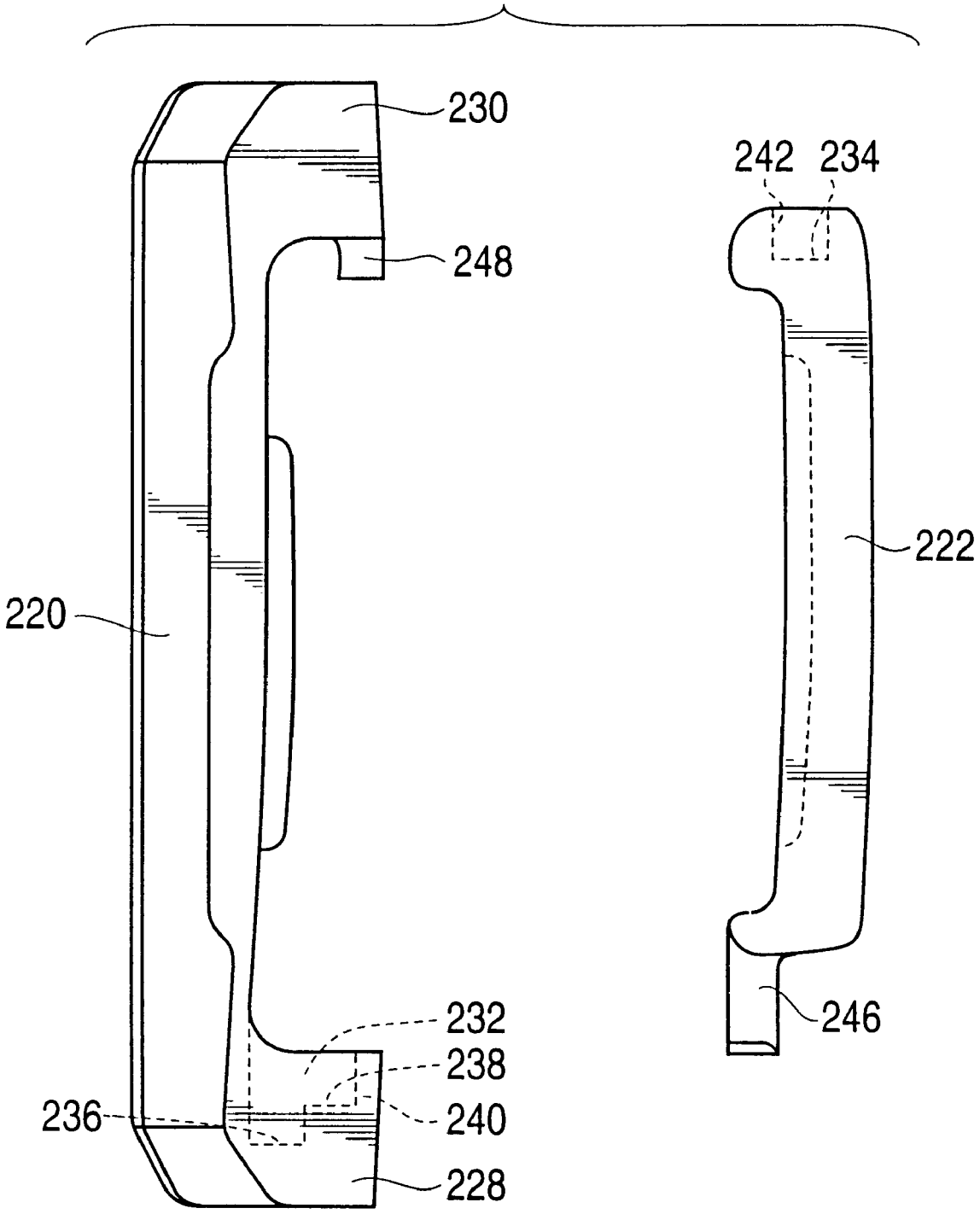
FIG. 19 is an exploded assembly view of the casing and insert in accordance with a third preferred embodiment of the locking pin.

In a third preferred embodiment, FIG. 19, casing 220 is provided with an assembly tab 248 on an arm 230 and a recess 232 on an arm 228. Correspondingly, insert 222 is provided with a recess 234 at one end and an assembly tab 246 on the other end. Of course the tab and recess arrangement could be reversed on arms 228 and 230. The sequence of assembly would begin with tilting of insert 222 to insert tab 246 into deeper portion 236 of recess 232. This allows tab 248 to clear abutment 242 of the insert, and be received in recess 234. When insert 222 is straightened out, tab 246 is seated within deep recess 236 and the bodies of casing 220 and insert 222 are brought into parallel relation. Insert 222 is then moved outward with respect to casing body 220 so that tab 246 is seated in shallow portion 238 of recess 232 and bears against locking abutment 240. Simultaneously tab 248 bear against locking abutment 242. In this manner tabs 246 and 248 are matingly received in recesses 232 and 234 so that the tabs bear against abutments 240 and 242 respectively. The casing and insert are thus constrained from movement in any direction except translationally toward and away from one another. Into the space defined between casing 120 and insert 122, an elastomer is interposed as described above to further lock the components into place.

The fourth and fifth preferred embodiments present a slightly different recess and structure. In these embodiments the tabs and recesses may be of equal length and depth since the tabs are inserted into the recesses from the side. The common feature in these embodiments is that viewed in cross-section the recesses would be L-shaped so that one leg of the L serves as the insertion area and the other leg of the L serves as the locking area including the locking abutment.

Figure 20:
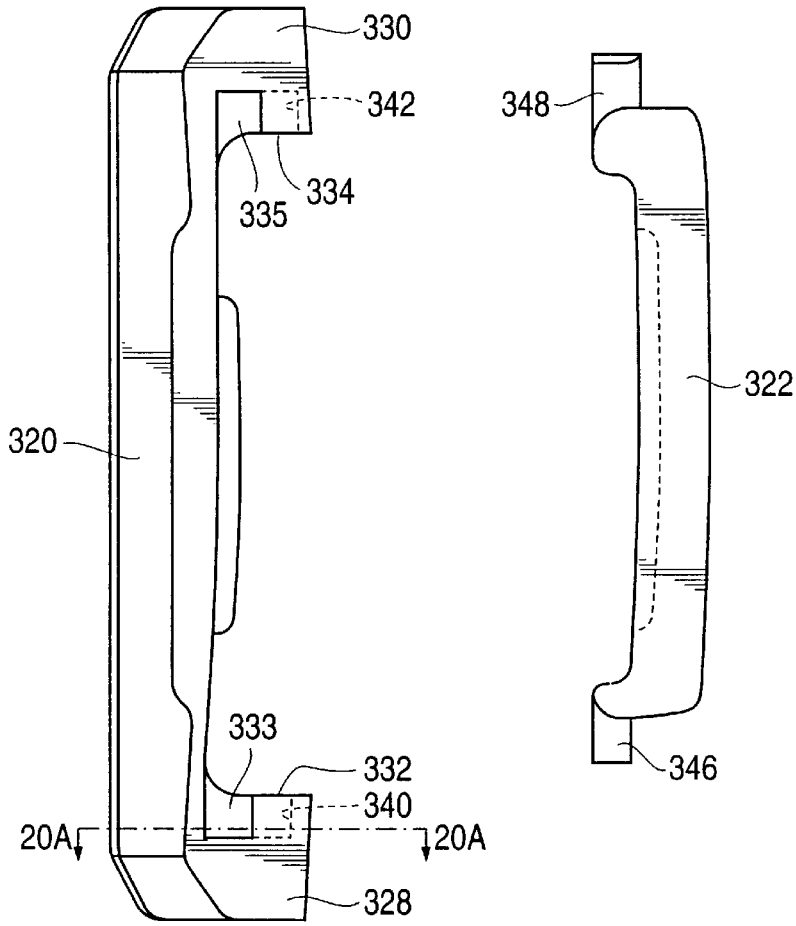
FIG. 20 is an exploded assembly view of the casing and insert in accordance with a fourth preferred embodiment of the locking pin.
Figure 20A:
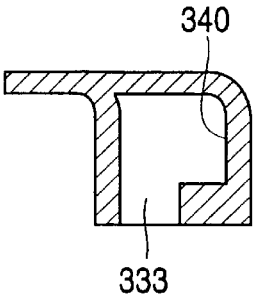
FIG. 20A is a cross-section taken generally along line 20A—20A of FIG. 20.

Specifically, in FIG. 20, casing 320 has recesses 332 and 334 which have open ends 333 and 335, and locking abutments 340 and 342, respectively. As seen in FIG. 20A, open ends or channels 333 and 335 are in angled relation to locking abutments 340 and 342, and preferably in perpendicular relation. Insert 322 includes assembly tabs 346 and 348 at its ends. To assemble the components together, insert 322 is positioned so that tabs 346 and 348 are inserted into open channels 333 and 335 respectively. Insert 322 is then moved with respect to casing 320 until tabs 346 and 348 bear against locking abutments 340 and 342 respectively. It will be apparent that in this embodiment insert 322 and casing 320 are in parallel relation throughout the assembly process. The casing and insert are thus constrained from movement in any direction except translationally toward and away from one another. Into the space defined between casing 320 and insert 322, an elastomer is interposed as described above to further lock the components into place.

Figure 21:
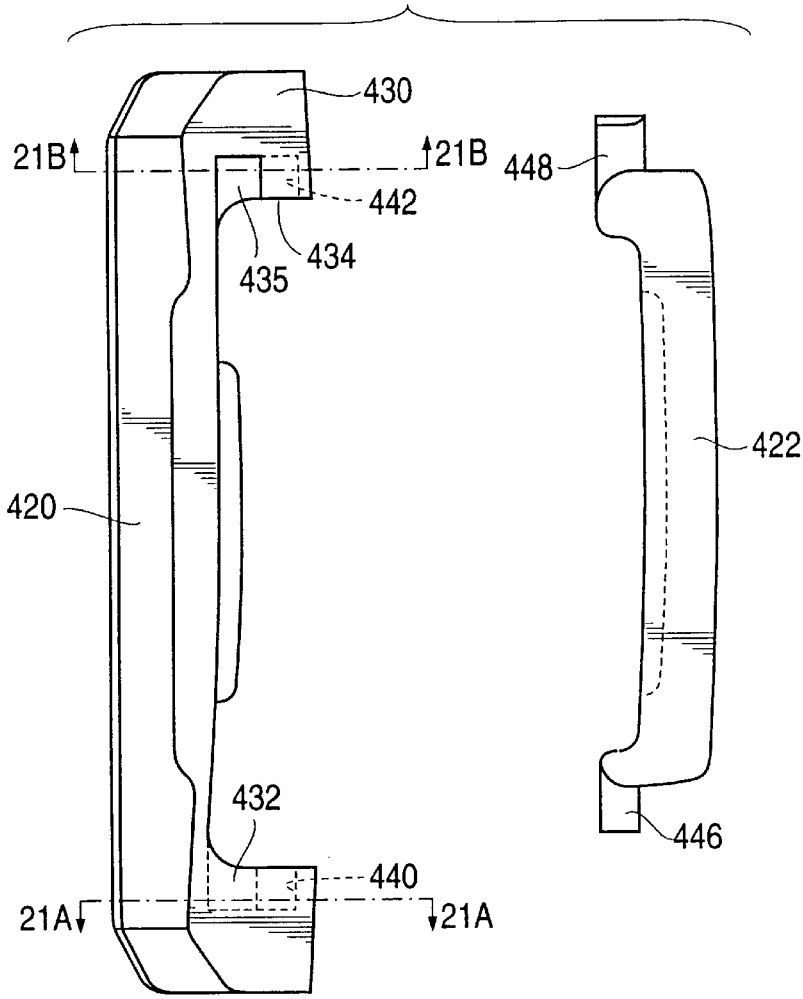
FIG. 21 is an exploded assembly view of the casing and insert in accordance with a fifth preferred embodiment of the locking pin.
Figure 21B:
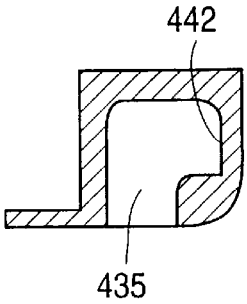
FIG. 21B is a cross-section taken generally along line 21B—21B of FIG. 21.
Figure 21A:
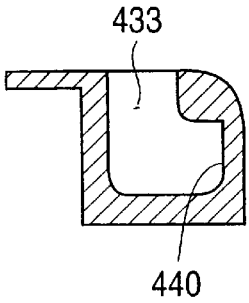
FIG. 21A is a cross-section taken generally along line 21A—21A of FIG. 21.

In the fifth preferred embodiment, FIG. 21, casing 420 has recesses 432 and 434 which have open ends or channels 433 and 435, and locking abutments 440 and 442, respectively. In contrast to FIG. 20 in which the open channels of the recesses are on the same side of the casing, the recesses of FIG. 21 have their open channels on opposite sides. That is, channel 435 is open to one side of casing 420, and channel 433 is open to the opposite side. Channels 433 and 435 are in angled relation to locking abutments 440 and 442, and preferably in perpendicular relation. Insert 422 includes assembly tabs 446 and 448 at its ends. To assemble the components together, insert 422 is rotated so that tabs 446 and 448 are positioned on opposites sides of casing 420 to insert the tabs into open channels 433 and 435 respectively. Insert 422 is then rotated with respect to casing 420 until the insert body 422 and casing 420 are in line which brings tabs 446 and 448 into recesses 432 and 434 respectively. Insert 422 is moved outward with respect to casing 420 until tabs 446 and 448 bear against locking abutments 440 and 442 respectively. In this embodiment insert 422 and casing 420 are in parallel relation throughout the assembly process but insert 422 is rotated with respect to casing 420 about a lateral axis. Once assembled the casing and insert are constrained from movement in any direction except translationally toward and away from one another. Into the space defined between casing 420 and insert 422, an elastomer is interposed as described above to further lock the components into place.

In all of the embodiments, the elastomer is oversized for the space between the casing and insert so that it preloads the assembled pin to increase the locking force of the three components. This pin consequently provides a higher average force for holding together the point and adapter nose over the range of compression of the pin as compared to conventional sandwich pins. In addition, this pin is easier to drive into an assembly since the casing and insert stay in essential parallel relation while being driven. This prevents the wedge action of prior art pins which squeeze together at the beginning and then spread apart making driving difficult. The present pin with the compressible elastomer also does not require inordinate pounding or special placement tools as would a rigid pin which was oversized for the space and forced into an interference fit.

Thus, the components of the completely assembled locking pin are tightly constructed together and present an integral piece for insertion into aligned locking apertures. Since the elastomer is held in place by structural constraints, there is no need for an adhesive to bond the elastomer to the metal parts. There is no concern therefore for the stability or durability of an adhesive when the piece is used even in corrosive environments. Also, the tightly assembled relationship of all three components ensures that no one piece can become loose and be ejected or lost even during applications of high forces.

The locking pin of the present invention is shown in the drawings as having certain outer contours and surfaces. The particular contours and surfaces are designed to be used with aligned locking apertures which have a corresponding inner contour. The preferred embodiment of the invention is a locking pin for dredge equipment, but the exterior contours and surfaces of the casing and insert can be varied without departing from the scope of the invention.

While the preferred embodiment of the locking pin is intended for use with excavating equipment, dredge equipment in particular, it is contemplated that the structure of the locking pin and the principles of its operation could be used to hold together any parts which have aligned assembly apertures.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited only by the claims appended hereto.

What is claimed is:

1. A locking pin for joining together parts by insertion of said locking pin into aligned locking apertures, said locking pin comprising:

a first rigid member having a first body portion and arms formed on each end of said first body portion, each of said arms having a recess such that said recesses face one another and are defined by locking abutments at their ends and lateral sides;

a second rigid member having a second body portion and tabs formed on each end of said second body portion, said tabs being adapted for insertion into said recesses to bear against said locking abutments when said second member is assembled to said first member, said first body portion being spaced away from said second body portion to define a space therebetween; and an elastomer member having locking tabs formed on each end of said elastomer member, said elastomer member interposed in said space between said first member and said second member, and said locking tabs being adapted to be inserted into said recesses such that said first member, said second member and said elastomer member are firmly locked together.

2. The locking pin of claim 1, wherein one of said recesses of said first member comprises a stepped configuration including a deep portion adjacent said first body and a shallow portion adjacent said locking abutment.

3. The locking pin of claim 1, wherein said first member and said elastomer engage one another by a mating rib and slot arrangement.

4. The locking pin of claim 1, wherein said second member and said elastomer engage one another by a mating rib and slot arrangement.

5. The locking pin of claim 1, wherein said elastomer is oversized such that assembly of said elastomer between said first member and said second member firmly affixes and preloads said locking pin.

6. A casing for a locking pin assembly comprising:

a longitudinal body portion; and laterally extending arms provided at the ends of said body portion defining exterior portions and interior portions, each of said arms having an assembly recess provided on the interior portion thereof for receiving tabs of an insert member, each said recess defined by a locking abutment at the free end of said arm and lateral sides, so as to constrain movement of the insert member relative to said casing in all directions except toward and away from one another.

7. The casing of claim 6, wherein one said assembly recess comprises a stepped configuration with a deep portion adjacent said body and a shallow portion adjacent said locking abutment enabling sequential assembly of the locking pin.

8. The casing of claim 6, further comprising a rib provided on said body for engagement of a mating slot on another component of said locking pin assembly.

9. A rigid insert component for a locking pin assembly, said insert adapted for assembly into a rigid casing, said insert comprising:

a longitudinal body portion including an engagement structure disposed along said body portion for engaging an elastomer component of the locking pin assembly; and insert tabs formed on each end of said body portion, said insert tabs being adapted for insertion into corresponding recesses of the casing to constrain said insert both vertically and laterally with respect to the casing.

10. The insert of claim 9, wherein said engagement structure comprises a longitudinal slot for receiving a mating rib on the other component.

11. A locking pin for joining together parts by insertion of said locking pin into aligned locking apertures, said locking pin comprising:

a first rigid member having a body extending in a longitudinal direction and including a first assembly structure;

a second rigid member having a body extending in the longitudinal direction and including a second assembly structure, said second rigid member assembled to said first rigid member and constrained in the longitudinal direction and in first and second lateral directions with respect to said first rigid member by cooperation of said first assembly structure with said second assembly structure; and an elastomer member interposed between said first member and said second member to resiliently bias said first and second rigid members apart.

12. The locking pin of claim 11, wherein said first assembly structure comprises arms formed on each end of said first rigid member, said arms extending in second lateral direction which is orthogonal to the first lateral direction, and each of said arms having a recess such that said recesses face one another.

13. The locking pin of claim 12, wherein said second assembly structure comprises tabs formed on each end of said second rigid member, said insert tabs being adapted for insertion into said recesses.

14. The locking pin of claim 12, wherein one of said recesses has a stepped configuration to enable sequential assembly of said locking pin.

15. The locking pin of claim 12, wherein one of said recesses includes a channel portion and a locking portion which is orthogonal to said channel portion.

16. The locking pin of claim 11, wherein said elastomer member cooperates with said first and second assembly structures to hold said first rigid member and said second rigid member in spaced relation.

17. The locking pin of claim 11, wherein said first rigid member and said elastomer member are engaged to one another by an engagement structure.

18. The locking pin of claim 11, wherein said second rigid member and said elastomer member are engaged to one another by an engagement structure.

19. The locking pin of claim 11, wherein said first assembly structure comprises arms formed on each end of said first rigid member, said arms extending in second lateral direction which is orthogonal to the first lateral direction, and each said arm having an insert tab provided thereon.

20. The locking pin claim 19, wherein said second assembly structure comprises a recess provided in each end of said second rigid member for receiving said insert tabs.

21. The locking pin of claim 11, wherein said first assembly structure comprises arms formed on each end of said first rigid member, said arms extending in a second lateral direction which is orthogonal to the first lateral direction, one said arm having a first insert tab provided thereon and the other said arm having a first recess provided therein.

22. The locking pin of claim 21, wherein said second assembly structure comprises a second recess provided in one end of said second rigid member for receiving said first insert tab, and a second insert tab provided on the other end of said second rigid member for insertion into said first recess.

* * * * *